United States Patent [19]

Ling

[11] Patent Number: 4,803,856

[45] Date of Patent: Feb. 14, 1989

[54] PLANARLY-OPERATING COMBINATION PADLOCK

[76] Inventor: Chong-Kuan Ling, P.O. Box 53-58, Taipei, Taiwan

[21] Appl. No.: 211,919

[22] Filed: Jun. 27, 1988

[51] Int. Cl.[4] ..... E05B 37/14

[52] U.S. Cl. ..... 70/28; 70/52

[58] Field of Search ..... 70/28, 29, 27, 41, 42, 70/52, 53, 287–288, 312

[56] References Cited

U.S. PATENT DOCUMENTS

| | | | |
|---|---|---|---|
| 598,974 | 2/1898 | Brode | 70/28 |
| 660,307 | 10/1900 | Owen | 70/53 |
| 1,293,879 | 2/1919 | Neumann | 70/29 |
| 1,728,902 | 9/1929 | Cohen | 70/53 |

*Primary Examiner*—Robert L. Wolfe

[57] ABSTRACT

A combination padlock includes a first cover having a fixed hasp secured on a left corner of the cover and a movable actuator pivotally formed on a right corner of the cover, a plurality of dials each coupled with a sleeve thereon pivotally mounted on the first cover, a sliding latch having a plurality of sleeve holes each hole having a tongue engageable with a notch formed in each sleeve, and a second cover integrally combined with the first cover to form a padlock casing, whereby upon a rotation of the dials and sleeves to disengage the sleeve notches from the latch tongues to raise the latch, the actuator will be retarded by the latch, unable to be inwardly depressed, for locking the padlock.

8 Claims, 3 Drawing Sheets

PLANARLY-OPERATING COMBINATION PADLOCK

BACKGROUND OF THE INVENTION

A conventional combination padlock as shown in FIG. 5 comprises a plurality of dials D pivotally mounted on a shackle S, each dial D being perpendicular to an axis A of one leg of the shackle S, which however may have some drawbacks as follows:

1. When it is intended to open such a padlock, the locking end of shackle S should be pulled upwardly and then rotated in direction R around the axis A to remove the padlock from a staple such as mounted on a door frame, causing an inconvenient operation therefor.

2. All dials D are perpendicular to the shackle S so that the lock casing can not be made so slim, thereby still requiring a big space for its handling and storage.

The present inventor has found such drawbacks and invented the present planarly-operating combination padlock to overcome the above-mentioned drawbacks.

SUMMARY OF THE INVENTION

The object of the present invention is to provide a planarly-operating combination padlock including a first cover having a fixed hasp secured on one corner of the first cover and having a biasing actuator pivotally mounted on the other corner of the first cover, a second cover in combination with the first cover to form a padlock casing, a plurality of dials pivotally mounted on the first cover, a plurality of sleeves correspondingly engageable with the dials, and a resilient sliding latch operatively engageable with the sleeves, wherein the biasing actuator is depressible to open the padlock when the sliding latch is downwardly engaged with the sleeves without obstructing the inward depression of the actuator; and the biasing actuator may close the fixed hasp for locking the padlock when the sliding latch is upwardly thrusted by the sleeves to retard the depression of the actuator, thereby forming a padlock which can be opened or closed in a plane generally coplanar to the first and second covers.

DETAILED DESCRIPTION

Figure 1:
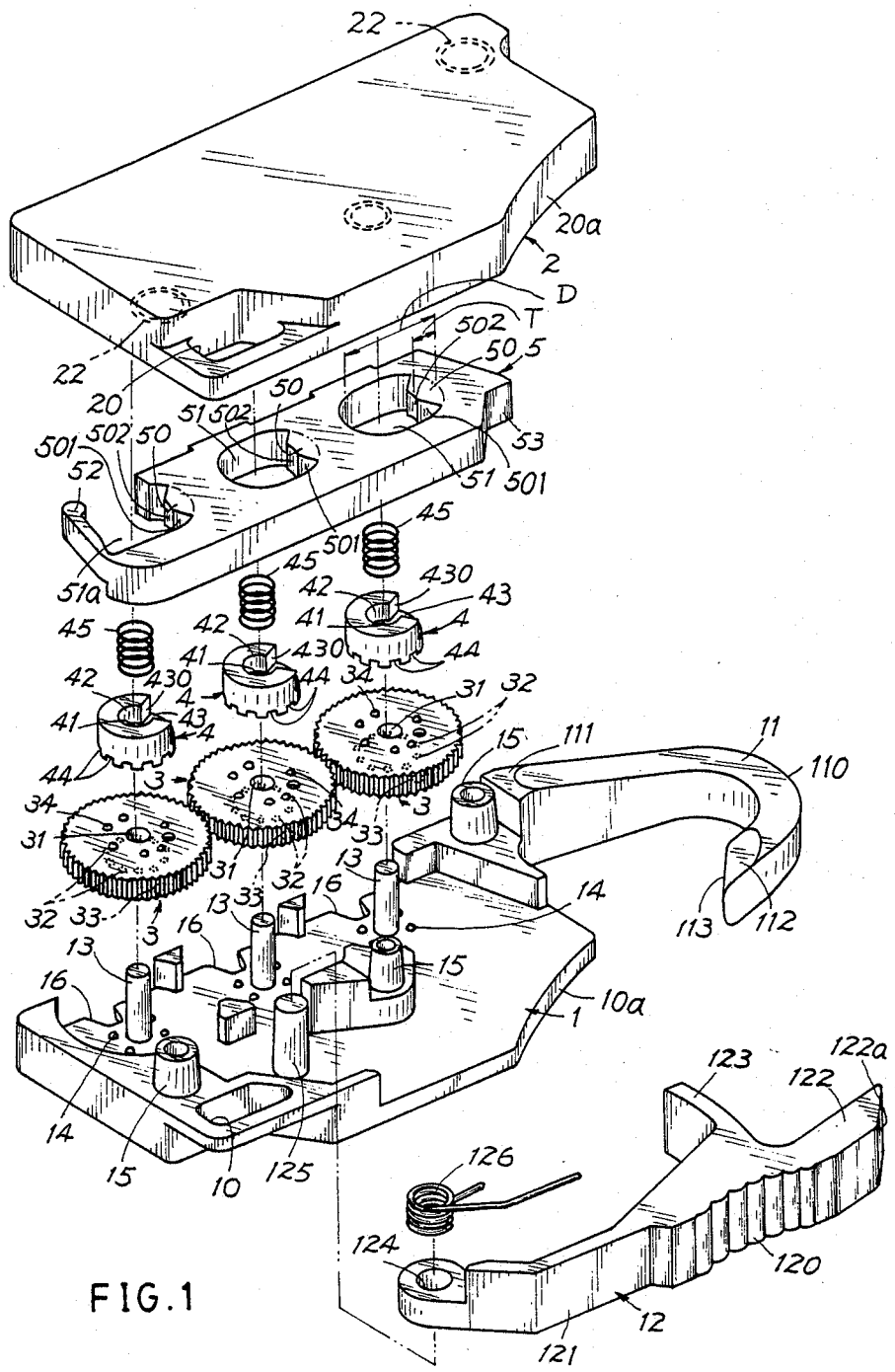
FIG. 1 is a perspective view showing all elements of the present invention.

As shown in FIGS. 1–4, the present invention comprises: a first cover 1, a second cover 2, a plurality of dials 3, a plurality of sleeves 4 and a resilient sliding latch 5.

The first cover 1 includes: a fixed hasp 11 secured to a left corner of a first transverse side 1*a* of the first cover 1, a biasing actuator 12 pivotally mounted on said cover 1 positioned on a right corner of the first transverse side 1*a* opposite to the left corner, a plurality of shafts 13 vertically formed on said cover 1 for pivotally mounting said dials 3, a plurality of beads 14 radially formed on the cover 1 around each shaft 13, plural stems 15 provided on the cover 1 engageable with plural sockets 22 formed in the second cover 2 for combining the second cover 2 with the first cover 1, and a plurality of notches 16 formed in a first longitudinal side 1*c* for showing the numerals 33 formed on the dials 3.

The first cover 1 is generally formed as a rectangular shape having a first transverse side 1*a*, a second transverse side 1*b* opposite to said first transverse side 1*a*, a first longitudinal side 1*c*, and a second longitudinal side 1*d* opposite to the first longitudinal side 1*c*; four sides 1*a*, 1*b*, 1*c*, 1*d* defining a generally rectangular shape. The second cover 2 is also formed as a rectangular shape corresponding to the first cover 1, both combined to form a lock casing. The two covers 1,2 are respectively formed with through holes 10, 20 so that the integrated casing will provide an opening for hanging this lock on a rope or chain. At the right corner of the casing, the covers 1,2 are formed with recesses 10*a*, 20*a* adapted for the depression of the actuator 12.

The fixed hasp 11 includes a central bending portion 110, a fixed end portion 111 disposed on a left side of the central bending portion 110 and secured on the left corner of the first transverse side 1*a*, and an opening end portion 112 disposed on a right side of the bending portion 110 defining an opening 114 between the opening end portion 112 and the first transverse side 1*a*. The opening 114 is adapted for engaging the hasp 11 with a staple S (FIG. 2*a*) such as mounted on a door frame for locking purpose or for removing the hasp 11 from the staple S through the opening 114. The opening end portion 113 is formed with an inclined surface tapered outwardly in a direction opposite to the central bending portion 110. The biasing actuator 12 generally formed as a "r" shape positioned adjacent to the second longitudinal side 1*d* includes a lower leg portion 121 having a pivot hole 124 pivotally connected in a pivot 125 formed on the first cover 1, an upper vertical arm portion 122 protruding upwardly from the leg portion 121 having an inclined surface 122*a* formed on an outermost end of the upper arm portion 122 tapered inwardly towards the bending portion 110 of the hasp 11, a horizontal arm portion 123 bifurcated inwardly towards the first longitudinal side 1*c* of the first cover 1, and a restoring spring 126 normally restoring the actuator 12 outwardly to allow the outermost end 122*a* of the upper arm portion 122 to engage the opening end portion 112.

An outer surface of the actuator 12 is formed with corrugated surface 120 for the depression of a user's finger. The actuator 12 is coplanar to the fixed hasp 11.

Each dial 3 with its diameter parallel to the cover 1 or 2 includes: a central hole 31 for pivotally mounting the dial on the shaft 13 of first cover 1, a plurality of recesses 32 formed in one surface of the dial and radially disposed around the central hole 31 to operatively engage the plural beads 14, ten numerals 33 radially formed on the dial surface, and a plurality of beads 34 radially formed on the other surface of the dial to operatively engage a plurality of recesses 44 formed in a sleeve 4.

Each sleeve 4 includes: a central hole 41 for pivotally mounting the sleeve 4 in the shaft 13 to superimposedly engage each dial 3, a central spring socket 42 for retaining a spring 45 held between the second cover 2 and the socket 42 to resiliently rotatively couple each sleeve 4 with each dial 3, a notch 43 formed in the sleeve to communicate with the spring socket 42 defining two inclined surfaces 430 diverging outwardly, and a plurality of recesses 44 formed in one surface opposite to the notch 43 to operatively engage the beads 34 of the dial 3.

Figure 2:
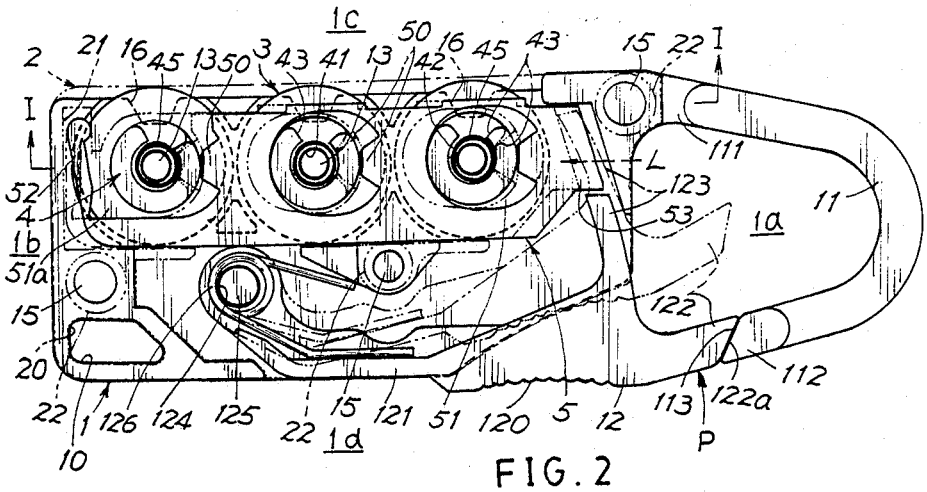
FIG. 2 is an illustration showing an assembled padlock of the present invention.
Figure 2A:
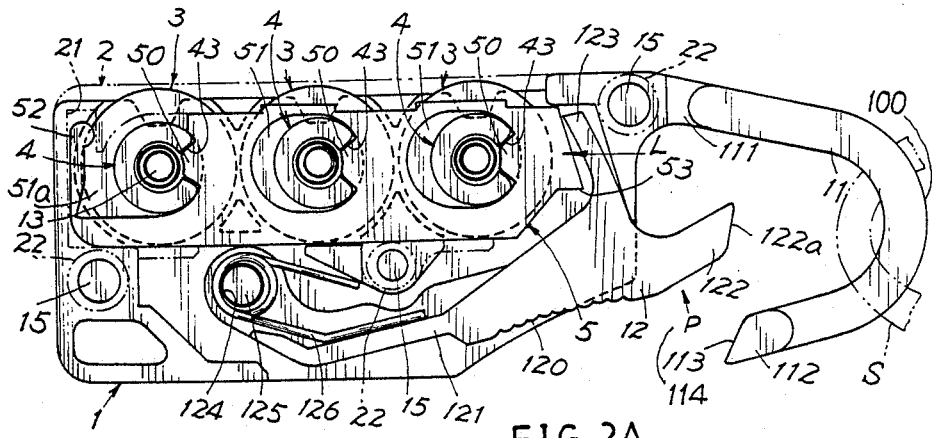
FIG. 2A shows a downwardly moving sliding latch when depressing a biasing actuator for setting a new combination in accordance with the present invention.
Figure 3:
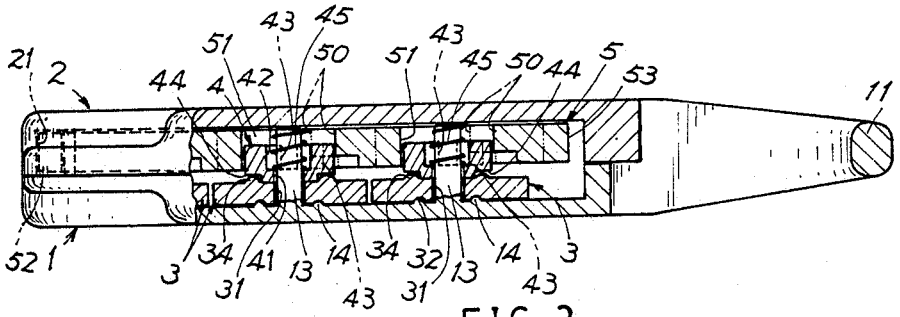
FIG. 3 is a sectional drawing of the present invention as viewed from I—I direction of FIG. 2.
Figure 4:
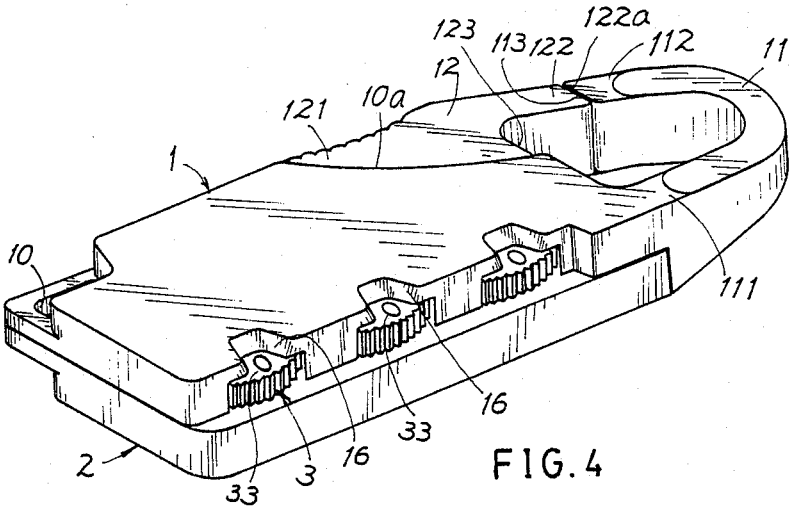
FIG. 4 is a perspective view of the present invention when reversing the padlock in 180 degrees as shown in FIG. 2.
Figure 5:
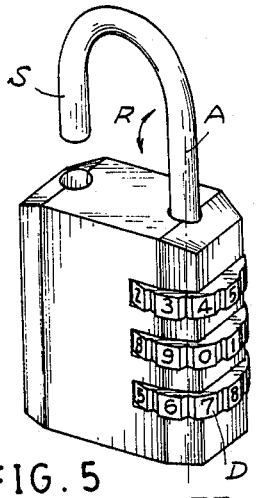
FIG. 5 PRIOR ART
FIG. 5 is a prior art showing a conventional padlock.

The resilient sliding latch 5 slidably formed adjacent to a first longitudinal side 1*c* of first cover 1 includes: a plurality of sleeve holes 51 formed in the latch operatively engaging the sleeves 4 therein, a restoring spring 52 formed on a lower portion of the latch held in a spring socket 21 formed in the second cover 2 adjacent to a second transverse side 1*b* of the first cover 1 to normally restore the latch 5 downwardly and an upper extension 53 formed on an upper portion of the latch opposite to the spring 52 to operatively retard the horizontal arm portion 123 of the actuator 12 when locking the present invention. Each sleeve hole generally formed as an ellipse 51 has a tongue portion 50 tapered downwardly from an upper periphery of the hole 51 defining two inclined surfaces 501 converging downwardly to operatively engage the two inclined surfaces 430 of a notch 43 of the sleeve 4 as shown in FIG. 2A, and a concave arcuate edge 502 laterally intersecting the two inclined surfaces 501 and operatively engaged with a sleeve circumference as shown in FIG. 2. A length between the arcuate edge 502 and a lower periphery of the hole 51 is generally equal to a diameter of the sleeve. It means that the sleeve diameter is equal to a length of a long axis D minus a longitudinal length T of the tongue portion 50 as shown in FIG. 1. A width of a short axis of the sleeve hole 51 is slightly larger than the sleeve diameter. The lowest hole 51*a* can be excavated from a side of the latch 5 to directly form such a spring 52 on the latch.

When locking the present invention, the dial 3 can be rotated to drive the sleeve 4 to allow the two inclined surfaces 430 of the notch 43 to thrust the two inclined surfaces 501 of the tongue portion 50 of the latch 5 to raise the latch, whereby the upper extension 53 of latch 5 will retard the horizontal arm portion 123 so that the actuator 12 can not be depressed inwardly to open the lock, and the spring 126 will restore the actuator 12 outwardly to allow the inclined surface 122*a* of the vertical arm portion 122 to be obstructed by the inclined surface 113 of the opening end of the hasp 11, thereby causing a locking position of the actuator 12 without inward or outward movement.

When opening the present invention by rotating the dials 3 to the opening combinations, the tongue portion 50 of the latch 5 will be downwardly pulled to engage the notch 43 of sleeve 4 by the restoring spring 52 to lower the extension 53 without retardig the horizontal arm portion 123, whereby upon the depression of the actuator 12, the vertical arm portion 122 will be opened from the hasp 11 to open the lock of this invention.

For changing a combination of the present invention, the actuator 12 is depressed to allow the horizontal arm portion 123 surpressing the latch 5 and engaging the tongue portion 50 with the sleeve notch 43, so that the dials 3 can be rotated, without being coupled with the sleeves 4, for setting a new combination.

The present invention is superior to a conventional combination padlock with the following advantages:

1. All elements are generally made as flat or slim shape for space-saving purpose.

2. The actuator 12 is planarly operated to open or close the lock for convenient operation therefor.

I claim:

1. A planarly operating combination padlock comprising:

a first cover having a fixed hasp secured on a left corner of said cover and a biasing actuator pivotally secured on a right corner opposite to said left corner resiliently closing an opening end of said fixed hasp, said actuator being coplanar to said fixed hasp;

a second cover having a dimension corresponding to said first cover for forming a padlock casing in combination with said first cover;

a plurality of dials pivotally mounted on said first cover, each dial having a diameter parallel to said first or second cover;

a plurality of sleeves superimposedly engageable with said dials, each sleeve retained by a spring held between said sleeve and said second cover to resiliently couple each said sleeve with said dial, each sleeve having a notch formed therein diverging outwardly from a center of the sleeve; and a resilient sliding latch slidably formed in the casing opposite to said biasing actuator including a plurality of sleeve holes each sleeve hole operatively engaging each sleeve having a tongue portion operatively engaging said notch of said sleeve, and a first restoring spring formed on a lower portion of said latch normally pulling said latch downwardly, and an upper extension formed on an upper portion of said latch operatively retarding said biasing actuator for locking said padlock; said casing having a recess formed on a right corner thereof, whereby upon rotation of said dials to an opening combination of said padlock, each said tongue portion of said latch is engaged with each said notch of said sleeve to lower said latch and said upper extension of said latch without retarding said actuator so as to allow an inward depression of said actuator to open said hasp and said padlock, and upon a rotation of the dials to close the padlock, each said notch of said sleeve will thrust each said tongue portion of said latch to raise said upper extension of said latch, remaining the depression of said actuator and locking the padlock.

2. A combination padlock according to claim 1, wherein said biasing actuator includes a lower leg portion pivotally formed on said first cover, an upper vertical arm portion having an outermost end formed as an inclined surface tapered inwardly towards a central bending portion of said fixed hasp operatively closing a lower opening end of said hasp, a horizontal arm portion bifurcated inwardly from said vertical arm portion being operatively retarded by said latch, and a second restoring spring retained on said first cover normally restoring said actuator outwardly to allow said vertical arm portion to close a second inclined surface tapered outwardly from the central bending portion of said hasp.

3. A combination padlock according to claim 1, wherein said notch of said sleeve defines two inclined surfaces diverging outwardly for engaging said tongue portion of said latch.

4. A combination padlock according to claim 1, wherein said sleeve hole in said latch generally formed as an ellipse has a length between said tongue portion formed on an upper periphery of the hole and a lower periphery of the hole equal to a diameter of said sleeve, and said sleeve hole has a width slightly larger than the diameter of said sleeve.

5. A combination padlock according to claim 1, wherein a lowest sleeve hole in said latch is excavated from a side of said latch to form said restoring spring directly on a lower portion of said latch.

6. A combination padlock according to claim 1, wherein said tongue portion of said latch defines two inclined surfaces tapered downwardly to operatively engage two said inclined surfaces of said sleeve notch when opening the padlock, and a concave arcuate edge formed on a lower edge of said tongue portion laterally intersecting said two inclined surfaces of said tongue portion and operatively engaging a circumference of said sleeve when locking the padlock.

7. A combination padlock according to claim 1, wherein said first and second covers are integrally combined to form a padlock casing having an opening formed through a corner thereof for hanging said casing on a rope or chain.

8. A combination padlock according to claim 7, wherein said casing is formed a recess on a right corner thereof adapted for an inward depression of said biasing actuator.

* * * * *